US010259674B2

(12) United States Patent
Sato

(10) Patent No.: US 10,259,674 B2
(45) Date of Patent: Apr. 16, 2019

(54) SHEET DISCHARGING DEVICE AND IMAGE FORMING APPARATUS THEREWITH

(71) Applicant: KYOCERA Document Solutions Inc., Osaka (JP)

(72) Inventor: Takehiro Sato, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/919,857

(22) Filed: Mar. 13, 2018

(65) Prior Publication Data

US 2018/0265321 A1 Sep. 20, 2018

(30) Foreign Application Priority Data

Mar. 14, 2017 (JP) ..... 2017-048399

(51) Int. Cl.

| | |
|---|---|
| ***B65H 31/00*** | (2006.01) |
| ***B65H 29/22*** | (2006.01) |
| ***G03G 15/00*** | (2006.01) |
| ***B65H 29/14*** | (2006.01) |
| ***G03G 21/16*** | (2006.01) |

(52) U.S. Cl.

CPC ..... *B65H 31/00* (2013.01); *B65H 29/14* (2013.01); *B65H 29/22* (2013.01); *G03G 15/6552* (2013.01); *G03G 21/1695* (2013.01); *B65H 2402/31* (2013.01); *B65H 2402/35* (2013.01); *B65H 2405/1117* (2013.01); *B65H 2405/354* (2013.01); *B65H 2407/21* (2013.01)

(58) Field of Classification Search

CPC ..... B65H 29/00; B65H 29/14; B65H 29/20; B65H 29/22; B65H 31/00; B65H 31/14; B65H 31/22; B65H 2402/31; B65H 2402/35; B65H 2402/45; B65H 2405/1117; B65H 2405/11172; B65H 2405/35; B65H 2405/354; B65H 2407/21

See application file for complete search history.

(56) References Cited

U.S. PATENT DOCUMENTS

| | | | | |
|---|---|---|---|---|
| 4,961,091 A * | 10/1990 | Kasuya | ..... | B65H 29/14 271/207 |
| 2003/0161705 A1* | 8/2003 | Trovinger | ..... | B42B 4/00 412/25 |
| 2008/0048387 A1* | 2/2008 | Matsumoto | ..... | B65H 31/02 271/207 |

FOREIGN PATENT DOCUMENTS

JP H 6-54351 U 7/1994

* cited by examiner

*Primary Examiner* — Prasad V Gokhale
(74) *Attorney, Agent, or Firm* — Stein IP, LLC

(57) ABSTRACT

A sheet discharging device has a discharge roller pair and a sheet discharge tray arranged selectively either in a first position where the sheet discharge tray is stowed along a side surface of an apparatus main body or in a second position where the sheet discharge tray, swung downward from the first position, protrudes beyond the side surface. The sheet discharge tray has a hook member holding, with one of rotation shafts of the discharge roller pair acting as an engagement shaft, the sheet discharge tray in the first position by engaging with the engagement shaft. As a result of the discharge roller pair being rotated with the sheet discharge tray located in the first position, an engagement releasing member fixed to the engagement shaft releases the engagement of the hook member with the engagement shaft, and the sheet discharge tray moves to the second position.

7 Claims, 9 Drawing Sheets

SHEET DISCHARGING DEVICE AND IMAGE FORMING APPARATUS THEREWITH

INCORPORATION BY REFERENCE

This application is based upon and claims the benefit of priority from the corresponding Japanese Patent Application No. 2017-048399 filed on Mar. 14, 2017, the entire contents of which are incorporated herein by reference.

BACKGROUND

The present disclosure relates to a sheet discharging device for discharging a sheet incorporated in an image forming apparatus such as a copier or a printer, and to an image forming apparatus provided with such a sheet discharging device.

Image forming apparatuses such as copiers and laser printers are provided with a sheet discharge tray for discharging a sheet having a predetermined image formed on it through an electro-photographic process or a document sheet having been conveyed from an auto document feeder to a document reading portion and subjected to document image reading. As such a sheet discharge tray, aside from a discharge tray provided in the top surface of the main body of or in an intra-body discharge space of the image forming apparatus, an auxiliary discharge tray is known that is openably and closably provided at a side surface of the main body of the image forming apparatus.

For example, a document tray fitting structure is known in which a retractable recording sheet cover is fitted openably and closably under a document discharge opening provided in a side surface of the main body of the image forming apparatus, and a document tray which receives a document sheet discharged from the document discharge opening is fitted openably and closably to the outer face of the recording sheet cover so as to swing about the same axis as the recording sheet cover.

SUMMARY

According to one aspect of the present disclosure, a sheet discharging device includes a discharge roller pair and a sheet discharge tray. The discharge roller pair is composed of a drive roller which rotates about a first rotation shaft and a driven roller which is driven to rotate about a second rotation shaft with the drive roller, and discharges a sheet from a side surface of an apparatus main body. The sheet discharge tray is arranged selectively either in a first position where the sheet discharge tray is stowed along the side surface of the apparatus main body or in a second position where the sheet discharge tray, swung downward form the first position, protrudes beyond the side surface of the apparatus main body so that the sheet discharged by the discharge roller pair is stackable on the sheet discharge tray. The sheet discharge tray has a hook member which holds, with the first rotation shaft or the second rotation shaft acting as an engagement shaft, the sheet discharge tray in the first position by engaging with the engagement shaft. To the engagement shaft, an engagement releasing member is fixed which presses, by the rotation of the engagement shaft, the hook member in a direction away from the rotation shaft. As a result of the discharge roller pair being rotated with the sheet discharge tray located in the first position, the engagement releasing member releases the engagement of the hook member with the engagement shaft, and the sheet discharge tray moves to the second position.

Further features and advantages of the present disclosure will become apparent from the description of embodiments given below.

DETAILED DESCRIPTION

Figure 1:
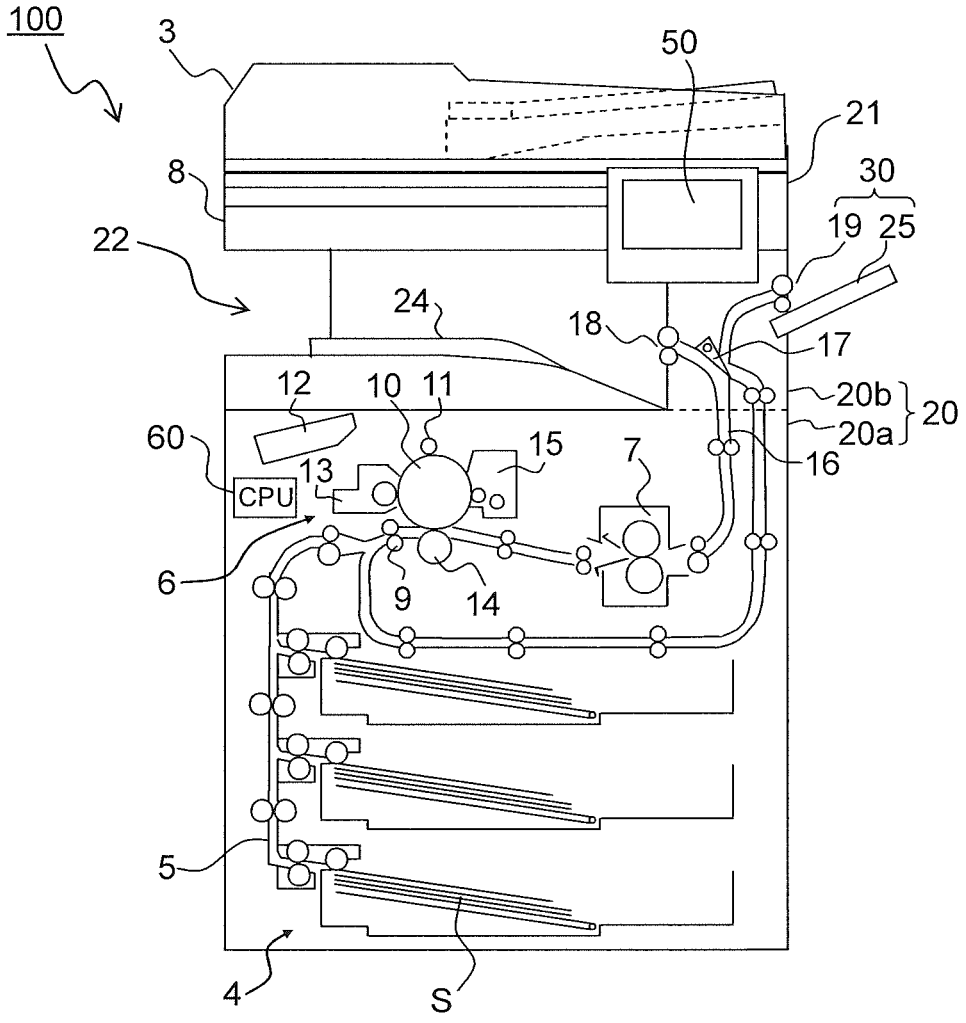
FIG. 1 is a schematic sectional view of an image forming apparatus incorporating a sheet discharging device according to the present disclosure.

Hereinafter, an embodiment of the present disclosure will be described in detail with reference to the accompanying drawings. FIG. 1 is a schematic diagram showing an internal structure of an image forming apparatus 100 incorporating a sheet discharging device 30 according to the present disclosure. As shown in FIG. 1, the image forming apparatus 100 is a digital multifunction peripheral of a so-called internal sheet discharge type, and roughly includes a body housing 20 and an upper housing 21 arranged over it.

The body housing 20 includes a lower housing 20*a* and a coupling housing 20*b* which is arranged above the lower housing 20*a* along a right side part in FIG. 1 and which is coupled to the upper housing 21. The lower housing 20*a* includes inside it a sheet feed portion 4 arranged in a lower part of the lower housing 20*a*, a sheet conveying portion 5 arranged to a side of and above the sheet feed portion 4, an image forming portion 6 arranged over the sheet feed portion 4, and a fixing portion 7 arranged on the downstream side (the right side in FIG. 1) of the image forming portion 6 in the sheet conveyance direction. In the coupling housing 20*b*, a first discharge roller pair 18 and a second discharge roller pair 19 are provided for conveying a sheet S having been subjected to fixing to discharge it out of the body housing 20.

The image forming portion 6 forms a predetermined toner image on a sheet S through an electrophotographic process. The image forming portion 6 includes a photosensitive drum 10, which is an image carrying member that is rotatably supported, and a charging device 11, an exposing device 12, a developing device 13, a transfer device 14, a cleaning device 15, and an unillustrated destaticizer, which are arranged around this photosensitive drum 10 along its rotation direction.

In the upper housing 21, an image reading portion 8 is provided. The image reading portion 8 reads image data of a document, and when a document is read one sheet at a time, with an auto document feeder 3 open, a document sheet is placed on a contact glass arranged on the top surface of the upper housing 21. On the other hand, when a document bundle is read automatically, the document bundle is placed on a sheet feed tray of the auto document feeder 3 in a closed state, and the document is automatically fed one sheet after another sequentially out of the document bundle onto the contact glass.

On the front surface side of the upper housing 21, there is arranged an operation panel 50 which displays the status of the image forming apparatus 100, the conditions for image formation, the number of copies, and the like and which permits various settings for the image forming apparatus 100. In the body housing 20, there is arranged a control portion (CPU) (controller) 60 which controls the operation of the image forming portion 6, the image reading portion 8, the sheet discharging device 30, and the like.

Now, a description will be given of the basic operation of the image forming apparatus 100 structured as described above. First, the surface of the photosensitive drum 10 that rotates in the counter-clockwise direction in FIG. 1 is electrostatically charged uniformly by the charging device 11. Subsequently, based on the image data read in the image reading portion 8, the circumferential surface of the photosensitive drum 10 is irradiated with a laser beam from the exposing device 12, and thereby an electrostatic latent image is formed on the surface of the photosensitive drum 10. To this electrostatic latent image, toner as developer is fed from the developing device 13, and thereby a toner image is formed.

In parallel with toner image formation, a sheet S is fed out from the sheet feed portion 4 to the sheet conveying portion 5, and is stopped temporarily at a registration roller pair 9. Then, the sheet S stopped at the registration roller pair 9 is conveyed, with predetermined timing, toward the photosensitive drum 10 having the toner image formed on it.

Then, the toner image on the surface of the photosensitive drum 10 is transferred to the sheet S by the transfer device 14 comprising a transfer roller or the like. Then, the sheet S having the toner image transferred to it is separated from the photosensitive drum 10, and is conveyed toward the fixing portion 7. The sheet S passes through the fixing portion 7 so that the toner image is fixed under application of heat and pressure.

The photosensitive drum 10 is, after completion of transfer of the toner image to the sheet S, subjected to removal of unused toner left on the circumferential surface by the cleaning device 15 and then to a discharging process in which remaining electric charge is removed by the destaticizer (unillustrated). Then, the circumferential surface of the photosensitive drum 10 is again electrostatically charged by the charging device 11, and thereafter image formation proceeds in the same manner.

The sheet S having passed through the fixing portion 7 is conveyed, as it is, into the coupling housing 20*b* along a vertical conveyance passage 16 extending perpendicularly upward. An upper part of the vertical conveyance passage 16 branches leftward and upward into two conveyance passages in the coupling housing 20*b*. The sheet S guided into the left conveyance passage by a switching guide 17 arranged in a branching portion, is discharged out to the left from the first discharge roller pair 18, and is stacked on a sheet discharge tray 24 formed on the bottom surface of an internal discharge space 22. On the other hand, the sheet S guided into the upper conveyance passage by the switching guide 17 is discharged out to the right from the second discharge roller pair 19, and is stacked on an auxiliary discharge tray 25. The second discharge roller pair 19 and the auxiliary discharge tray 25 constitute the sheet discharging device 30 according to the present disclosure.

Figure 2:
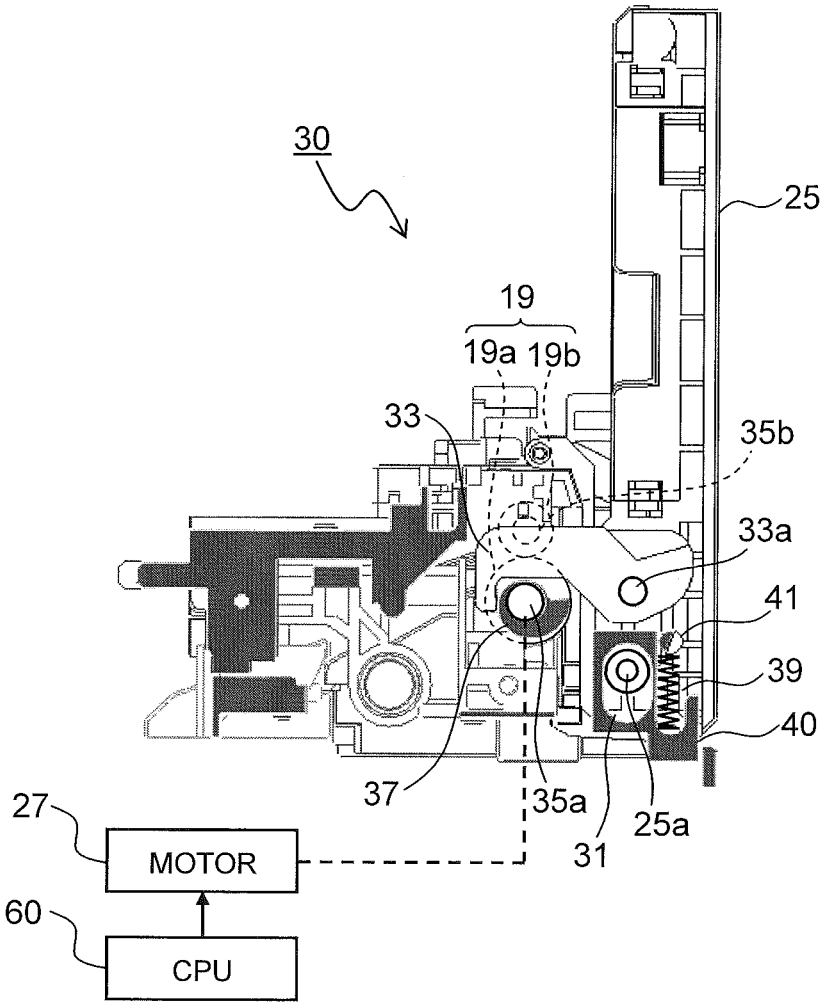
FIG. 2 is a side sectional view of the sheet discharging device according to one embodiment of the present disclosure, showing a state where an auxiliary discharge tray is located in a closed position.
Figure 3:
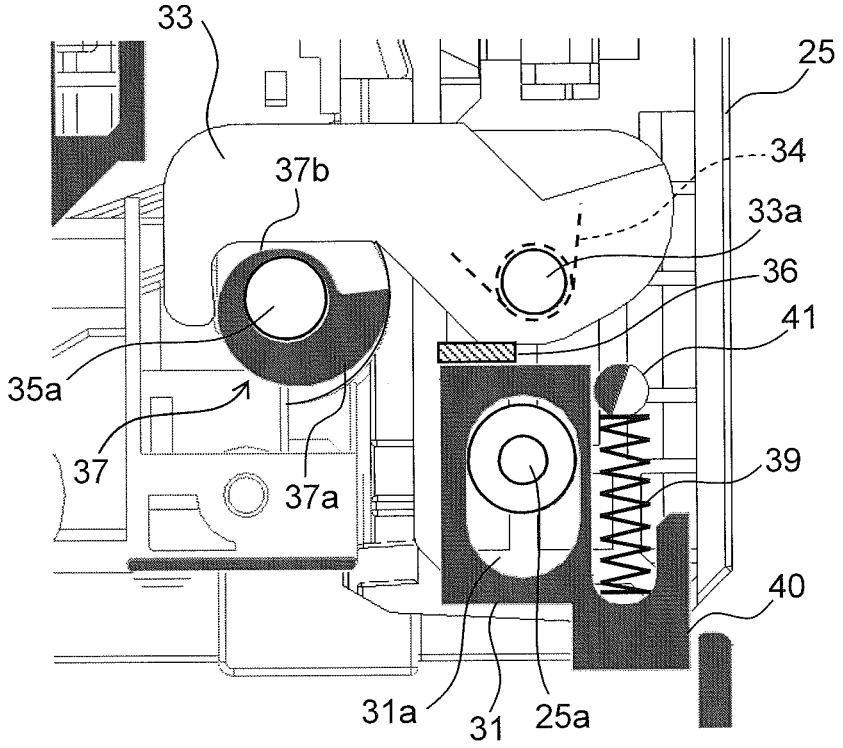
FIG. 3 is a partly enlarged view around a support shaft of the auxiliary discharge tray in FIG. 2.

FIG. 2 is a side sectional view of the sheet discharging device 30 incorporated in the image forming apparatus 100. FIG. 3 is an enlarged view around a support shaft 25*a* of the auxiliary discharge tray 25 in FIG. 2. FIG. 2 shows a state where the auxiliary discharge tray 25 is arranged in a closed position. The sheet discharging device 30 includes the auxiliary discharge tray 25 and the second discharge roller pair 19 which discharges a sheet onto the auxiliary discharge tray 25.

The auxiliary discharge tray 25 is used to discharge specialty paper such as facsimile paper, envelopes, postcards, and invoices. The auxiliary discharge tray 25 is arranged selectively either in a closed position (first position) where the auxiliary discharge tray 25 is stowed along a side surface of the body housing 20, and constitutes part of the side surface of the body housing 20 or in an open position (second position) where the auxiliary discharge tray 25, swung downward from the closed position, protrudes beyond the side surface of the body housing 20 so that sheets S discharged by the second discharge roller pair 19 can be stacked on the auxiliary discharge tray 25. In a lower end part of the auxiliary discharge tray 25, the support shaft 25*a* is arranged which serves as a fulcrum of opening and closing movement. The support shaft 25*a* is rotatably and slidably supported in an oblong bearing hole 31*a* in a bearing portion 31 arranged on the body housing 20 side.

The second discharge roller pair 19 is composed of a rubber discharge roller (drive roller) 19*a* which can rotate in the forward and reverse directions about a rotation shaft (first rotation shaft) 35*a* by the action of a motor 27 and a resin discharge wheel (driven roller) 19*b* which rotates about a rotation shaft (second rotation shaft) 35*b* by following the discharge roller 19*a* as it rotates.

The auxiliary discharge tray 25 is provided with a hook member 33 which holds the auxiliary discharge tray 25 in the closed position. The hook member 33 is supported on the auxiliary discharge tray 25 so as to be pivotable about a swing shaft 33*a* as a fulcrum arranged slightly above the support shaft 25*a*. When the hook member 33 is engaged with a rotation shaft 35*a* of the discharge roller 19*a*, the auxiliary discharge tray 25 is held in the closed position. The swing shaft 33*a* is provided with a torsion spring (biasing member) 34, and the hook member 33 is biased in a direction engaging with the rotation shaft 35*a* (in the counter-clockwise direction in FIG. 3) by the biasing force of the torsion spring 34. The auxiliary discharge tray 25 is further provided with a stopper 36 which restricts the swinging of the hook member 33 in the counter-clockwise direction.

To the rotation shaft 35*a*, an eccentric cam (engagement releasing member) 37 is fixed. The eccentric cam 37 has a large diameter portion 37*a* and a small diameter portion 37*b* such that the distance from the center of rotation of the eccentric cam 37 to its circumferential surface continuously varies. The eccentric cam 37 is arranged at a position overlapping the hook member 33 in the axial direction of the rotation shaft 35*a* (in the direction perpendicular to the plane of FIG. 3).

Near the support shaft 25*a* of the auxiliary discharge tray 25, a compression spring 39 is arranged. The compression spring 39 is arranged at a position deviated from the support shaft 25*a* in the swinging direction of the auxiliary discharge tray 25 toward the open position (rightward in FIG. 3). A bottom end part of the compression spring 39 is in contact with a spring holding portion (damper holding portion) 40 formed integrally with the bearing portion 31. Near a top end part of the compression spring 39, a pressing pin (pressing protrusion) 41 is provided. The pressing pin 41 is supported so as to be movable in the up-down direction to the body housing 20 side, and as the auxiliary discharge tray 25 is swung from the closed position to the open position, the pressing pin 41 moves downward by the weight of the auxiliary discharge tray 25 and presses the top end part of the compression spring 39. A plurality of second discharge roller pairs 19 are arranged in the sheet width direction (the direction perpendicular to the plane of FIG. 3), and the hook member 33, the eccentric cam 37, the compression spring 39, and both ends of the support shaft 25*a* (fulcrum portion) are arranged respectively in pairs on both sides in the sheet width direction.

Figure 4:
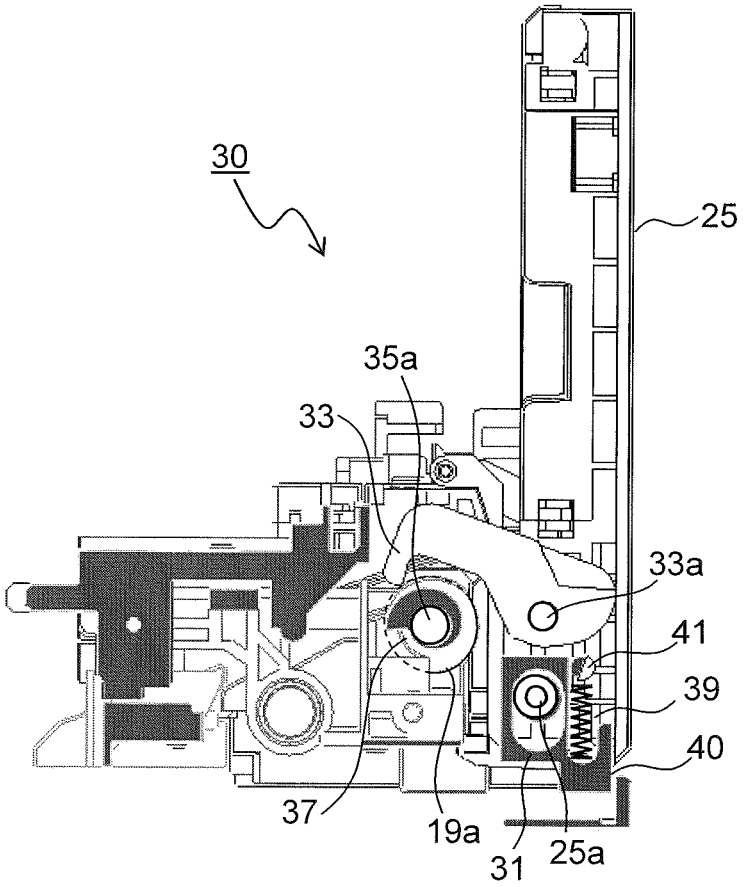
FIG. 4 is a side sectional view of the sheet discharging device as observed when its discharging operation to the auxiliary discharge tray is started from the state in FIG. 2.
Figure 5:
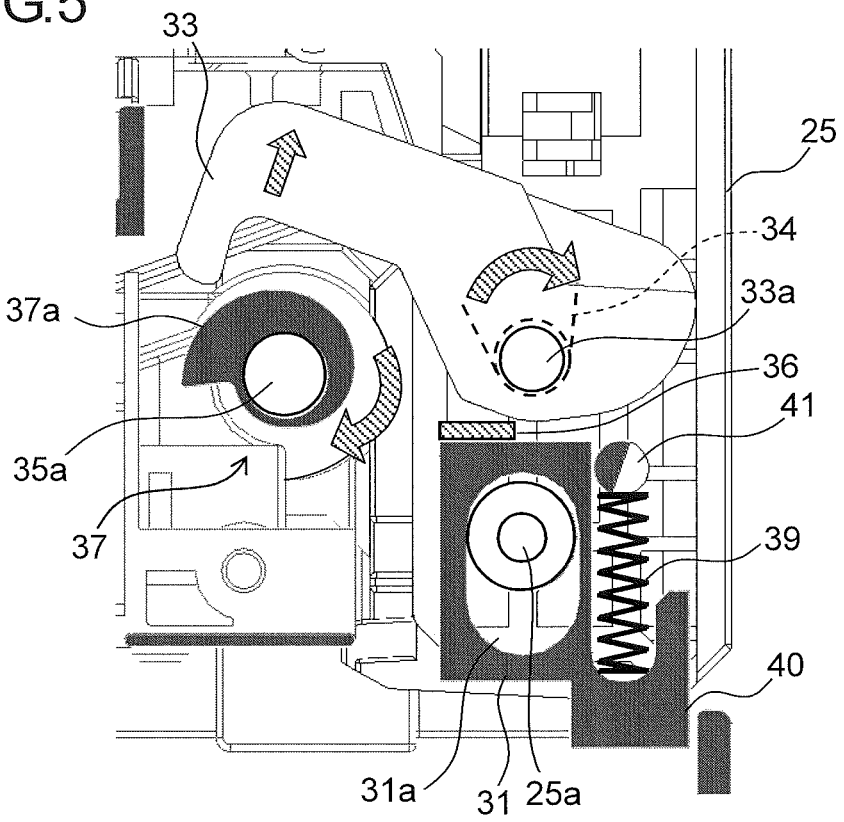
FIG. 5 is a partly enlarged view around the support shaft of the auxiliary discharge tray in FIG. 4.

FIG. 4 is a side sectional view of the sheet discharging device 30 as observed when, from the state in FIG. 2, its discharging operation to the auxiliary discharge tray 25 is started. FIG. 5 is an enlarged view around the support shaft 25*a* of the auxiliary discharge tray 25 in FIG. 4.

When a print instruction that involves the discharging operation to the auxiliary discharge tray 25 is fed in on the operation panel 50 (see FIG. 1), a control signal is transmitted from the control portion 60 (see FIG. 1) to the motor 27 (see FIG. 2) to start the rotation of the discharge roller 19*a*. As the discharge roller 19*a* rotates, the eccentric cam 37 fixed to the rotation shaft 35*a* of the discharge roller 19*a* rotates in the same direction (the clockwise direction in FIG. 5); thereby, as shown in FIG. 5, by the large diameter portion 37*a* of the eccentric cam 37, the hook member 33 is pushed up in a direction away from the rotation shaft 35*a* against the biasing force of the torsion spring 34. As a result, the hook member 33 swings in the clockwise direction about the swing shaft 33*a* as a fulcrum, and thus the engagement of the hook member 33 with the rotation shaft 35*a* is released.

Thus, by the action of the biasing force of the torsion spring 34, the auxiliary discharge tray 25, which has been held in the closed position by the hook member 33, falls outward (rightward in FIG. 4) and swings downward about the support shaft 25*a*. In the manner described above, the auxiliary discharge tray 25 moves from the closed position shown in FIG. 2 to the open position shown in FIG. 6.

With the configuration according to this embodiment, when a print instruction that involves the discharging operation to the auxiliary discharge tray 25 is fed in with the auxiliary discharge tray 25 held in the closed state, by the rotation of the discharge roller 19*a*, the auxiliary discharge tray 25 automatically moves to the open position. Thus, even when a print instruction is fed in with the auxiliary discharge tray 25 located in the closed position, it is possible to reliably prevent trouble such as a sheet S jamming, or a sheet S being discharged onto a tray (the sheet discharge tray 24) unintended by a user as a result of, in a configuration including a detection device (unillustrated) for detecting the auxiliary discharge tray 25 being held in the closed position, the control portion 60 (see FIG. 1) receiving a detection signal from the detection device.

By use of the discharge roller 19*a* which inevitably rotates in the discharging operation to the auxiliary discharge tray 25, it is possible to move the auxiliary discharge tray 25 to the open position. Thus, there is no need to provide a solenoid or a motor dedicated to opening the auxiliary discharge tray 25, and this suppresses an increase in the number of components and makes the controlling channels simple.

Figure 6:
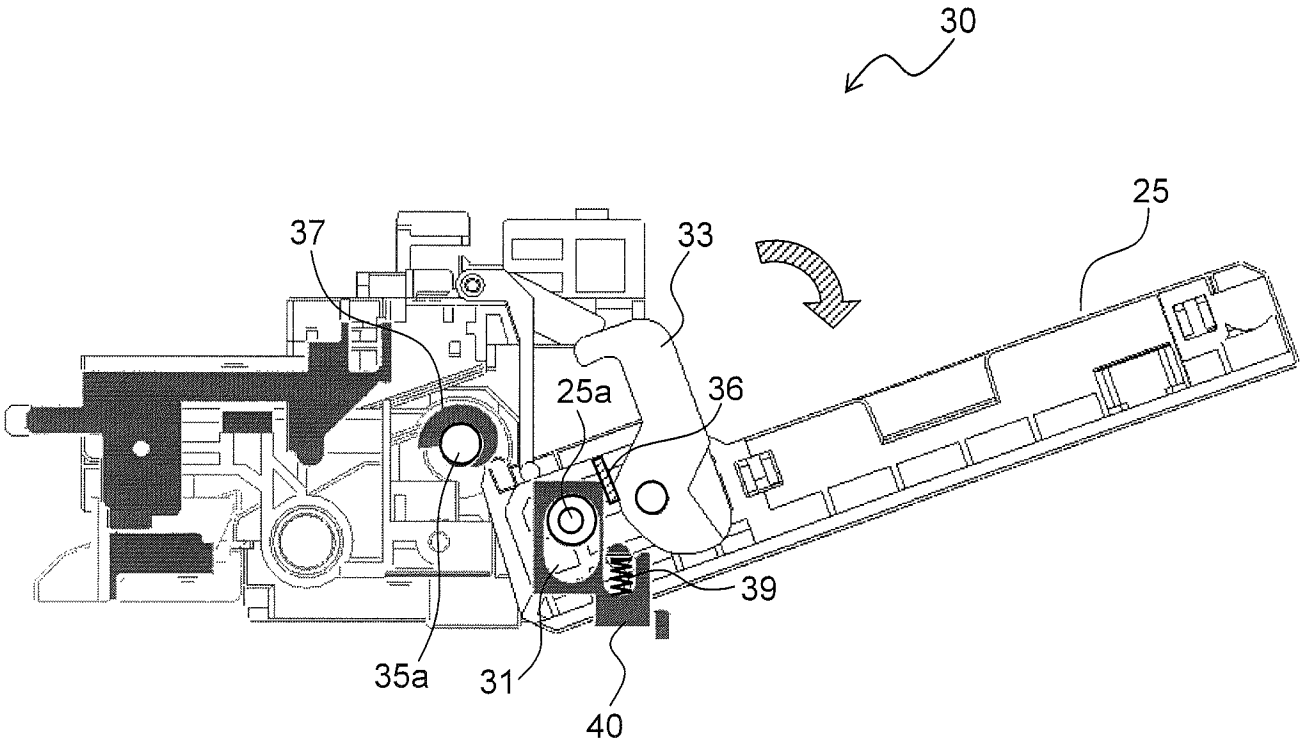
FIG. 6 is a side sectional view of the sheet discharging device according to the embodiment, showing a state where the auxiliary discharge tray is located in an open position.
Figure 7:
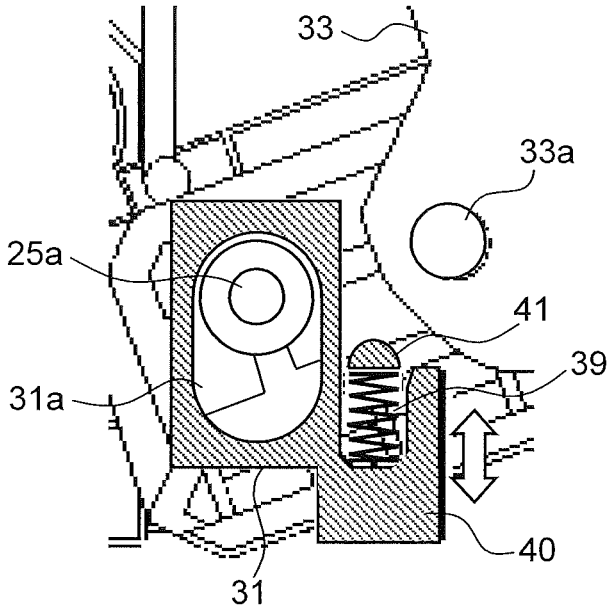
FIG. 7 is a partly enlarged view around the support shaft of the auxiliary discharge tray in FIG. 6.

FIG. 7 is a partly enlarged view around the support shaft 25*a* of the auxiliary discharge tray 25 in a state (the state in FIG. 6) where the auxiliary discharge tray 25 has moved to the open position. As shown in FIG. 7, as the auxiliary discharge tray 25 swings downward (toward the open position), the pressing pin 41 moves downward along an arc-form swing locus about the support shaft 25*a* as a center. On the other hand, the compression spring 39 is arranged so as to be extendable and contractible in the vertical direction. Then, when the auxiliary discharge tray 25 swings close to the open position, the pressing pin 41 makes contact with the compression spring 39. Thus, the pressing pin 41 which moves downward by receiving the weight of the auxiliary discharge tray 25 presses the top end part of the compression spring 39, and thus the compression spring 39 is compressed between the spring holding portion 40 and the pressing pin 41. Here, the restoring force (biasing force) of the compression spring 39 acts as a damper when the auxiliary discharge tray 25 is opened; it is thus possible to effectively suppress impact noise generated when the auxiliary discharge tray 25 moves from the closed position to the open position and breakage of the auxiliary discharge tray 25 resulting from the impact.

Thereafter, a sheet S is fed out from the sheet feed portion 4 (see FIG. 1), and based on the image data read in the image reading portion 8 (see FIG. 1), a toner image is formed on the sheet S in the image forming portion 6 (see FIG. 1). Then, the sheet S passes through the fixing portion 7 (see FIG. 1) so that the toner image is fixed to the sheet S, and then the sheet S is stacked on the auxiliary discharge tray 25.

In the state in FIG. 6 where no sheets S are stacked on the auxiliary discharge tray 25 located in the open position, as shown in FIG. 7, the pressing pin 41 is in contact with the top end part of the compression spring 39, and by the biasing force of the compression spring 39, the auxiliary discharge tray 25 is held at a predetermined height such that sheets S discharged from the second discharge roller pair 19 can be smoothly stacked on the auxiliary discharge tray 25. Here, the support shaft 25*a* of the auxiliary discharge tray 25 is located in an upper part of the bearing hole 31*a*.

Figure 8:
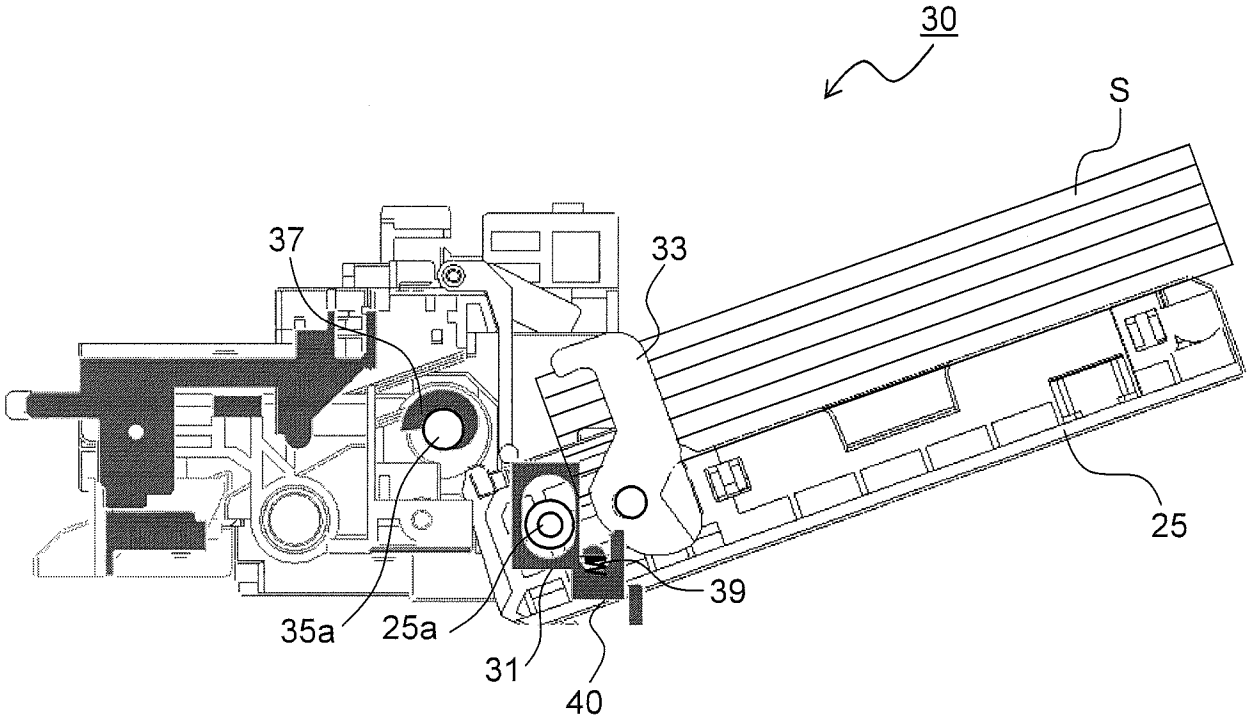
FIG. 8 is a side sectional view of the sheet discharging device according to the embodiment, showing a state where sheets are stacked on the auxiliary discharge tray.
Figure 9:
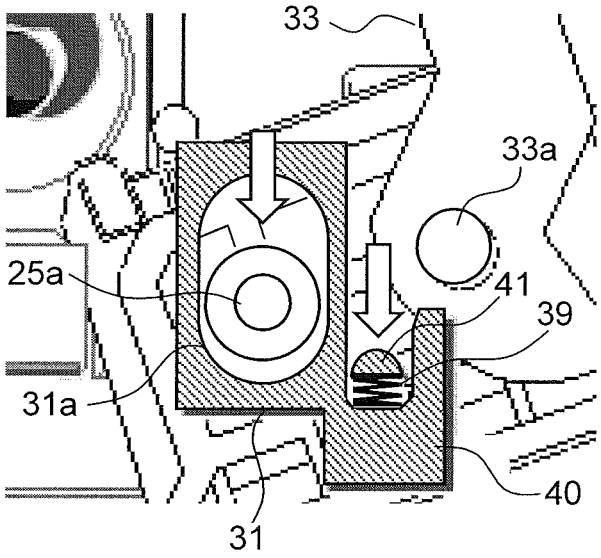
FIG. 9 is a partly enlarged view around the support shaft of the auxiliary discharge tray in FIG. 8.

FIG. 8 is a side sectional view of the sheet discharging device 30, showing a state where sheets S are stacked on the auxiliary discharge tray 25. FIG. 9 is a partly enlarged view around the support shaft 25*a* of the auxiliary discharge tray 25 in the state in FIG. 8. As sheets S are sequentially stacked on the auxiliary discharge tray 25, according to the weight of the sheets S, the pressing force applied from the pressing pin 41 to the compression spring 39 increases. On the other hand, even when the weight (pressing force) of the sheets S acts on the auxiliary discharge tray 25 located in the open position, the auxiliary discharge tray 25 does not swing any further. Thus, as the number of sheets S stacked increases, the amount by which the compression spring 39 is compressed increases, with the result that the auxiliary discharge tray 25 moves downward. Then, when, as shown in FIG. 8, the auxiliary discharge tray 25 is full with sheets S, as shown in FIG. 9, the support shaft 25*a* of the auxiliary discharge tray 25 moves to a lower part of the bearing hole 31*a*.

As described above, as the number of sheets S stacked increases, the auxiliary discharge tray 25 moves downward; it is thus possible to increase the number of sheets S that can be stacked on the auxiliary discharge tray 25. Irrespective of the number of sheets S stacked, the height of the top surface of the sheets S stacked on the auxiliary discharge tray 25 relative to the second discharge roller pair 19 is held constant; it is thus possible to prevent trouble such as a previously stacked sheet S being pushed out by a sheet S discharged from the second discharge roller pair 19, or a sheet S being discharged with its tip end curled up toward the upstream side in the discharge direction, hence stacked with the reverse side up. That is, it is possible to achieve smoother stacking of sheets S on the auxiliary discharge tray 25.

In the state in FIG. 6 where the engagement of the hook member 33 with the rotation shaft 35*a* is released, the hook member 33 is, by making contact with the stopper 36 provided on the auxiliary discharge tray 25, held in a position substantially perpendicular to the auxiliary discharge tray 25.

The phase (rotation angle) of the eccentric cam 37 as observed when the second discharge roller pair 19 is stopped is not constant, and thus the large diameter portion 37*a* of the eccentric cam 37 can be sometimes located over the rotation shaft 35*a*. However, the rotational torque of the rotation shaft 35*a* as observed when no driving force is fed to the discharge roller 19*a* is so small that the hook member 33 can engage with the rotation shaft 35*a* while rotating the eccentric cam 37 in the counter-clockwise direction.

When the auxiliary discharge tray 25 is opened manually, as a force in the opening direction is applied to the auxiliary discharge tray 25 from the state in FIG. 3, the hook member 33 swings, over the eccentric cam 37, in the counter-clockwise direction against the biasing force of the torsion spring 34, and the engagement of the hook member 33 with the rotation shaft 35 is released as shown in FIG. 5.

The embodiments described above are in no way meant to limit the present disclosure, which thus allows for many modifications and variations within the spirit of the present disclosure. For example, although the above-described embodiment deals with a configuration where the hook member 33 is engaged with the rotation shaft 35*a* of the discharge roller 19*a* and the engagement of the hook member 33 with the rotation shaft 35*a* is released by the eccentric cam 37 fixed to the rotation shaft 35, instead the hook member 33 may be engaged with a rotation shaft 35*b* of the discharge wheel 19*b* and the engagement of the hook member 33 with the rotation shaft 35*b* may be released by the eccentric cam 37 fixed to the rotation shaft 35*b* of the discharge wheel 19*b*. That is, with the rotation shaft 35*a* or the rotation shaft 35*b* acting as an engagement shaft, the hook member 33 holds the auxiliary discharge tray 25 in the closed position by engaging with the engagement shaft. In place of the eccentric cam 37, a protrusion having such a shape as to protrude radially from a part of the circumferential surface of the rotation shaft 35*a* or the rotation shaft 35*b* may be formed integrally with the rotation shaft 35*a* or the rotation shaft 35*b*. Although the above-described embodiment deals with a plurality of discharge roller pairs 19, a plurality of hook members 33, a plurality of eccentric cams 37, instead, one of each may be provided.

Although the above-described embodiment deals with the sheet discharging device 30 provided with the auxiliary discharge tray 25 on which a sheet S having an image formed on it is stacked, the present disclosure is applicable equally to sheet discharging devices provided with a discharge tray that can be opened and closed at a side surface of the apparatus main body, such as a document discharge tray for discharging a document sheet having been conveyed from the auto document feeder 3 to the image reading portion 8 and subjected to document image reading, or a sheet discharge tray provided with a sheet post-processing device in which a sheet having an image formed on it is subjected to punch-hole formation or stapling.

The present disclosure is applicable to sheet discharging devices provided with a sheet discharge tray that is provided to be openable and closable at a side surface of an apparatus main body and that holds a sheet discharged. Based on the present disclosure, it is possible to provide a sheet discharging device that can automatically open a sheet discharge tray when a job to perform discharging to the sheet discharge tray is fed in with the sheet discharge tray held in the closed position, and to provide an image forming apparatus incorporating such a sheet discharging device.

What is claimed is:

1. A sheet discharging device comprising:

a discharge roller pair composed of a drive roller which rotates about a first rotation shaft and a driven roller which is driven to rotate about a second rotation shaft with the drive roller, the discharge roller pair discharging a sheet from a side surface of an apparatus main body;

a sheet discharge tray arranged selectively either in a first position where the sheet discharge tray is stowed along the side surface of the apparatus main body or in a second position where the sheet discharge tray, swung downward from the first position, protrudes beyond the side surface of the apparatus main body so that the sheet discharged by the discharge roller pair is stackable on the sheet discharge tray;

a hook member provided on the sheet discharge tray to be pivotable about a swing shaft, the hook member holding, with the first rotation shaft or the second rotation shaft acting as an engagement shaft, the sheet discharge tray in the first position by engaging with the engagement shaft; and an engagement releasing member fixed to the engagement shaft, the engagement releasing member pressing, by rotation of the engagement shaft, the hook member in a direction away from the engagement shaft, wherein as a result of the discharge roller pair being rotated with the sheet discharge tray located in the first position, the engagement releasing member releases engagement of the hook member with the engagement shaft, and the sheet discharge tray moves to the second position.

2. The sheet discharging device of claim 1, wherein the engagement releasing member is an eccentric cam that is fixed on the engagement shaft and has a circumferential surface in contact with the hook member, and the circumferential surface is formed such that a distance from a center of rotation of the eccentric cam to the circumferential surface of the eccentric cam continuously varies.

3. The sheet discharging device of claim 1, further comprising:

a biasing member which biases the hook member in a direction engaging with the engagement shaft; and a stopper provided on the sheet discharge tray, the stopper restricting swinging of the hook member caused by the biasing member, wherein with the sheet discharge tray located in the second position, the hook member is held by making contact with the stopper in a position substantially perpendicular to the sheet discharge tray.

4. The sheet discharging device of claim 1, further comprising:

damper members provided on the side surface of the apparatus main body, the damper members damping an impact occurring when the sheet discharge tray moves to the second position;

fulcrum portions provided in a lower end part of the sheet discharge tray, the fulcrum portions supported on the side surface of the apparatus main body;

bearing portions provided on the side surface of the apparatus main body, the bearing portions supporting the fulcrum portion rotatably;

damper holding portions which are provided integrally with the bearing portion and to which the damper members are attached; and pressing protrusions provided near the fulcrum portion, the pressing protrusions being in contact with the damper members when the sheet discharge tray is open.

5. The sheet discharging device of claim 4, wherein each of the bearing portions has an oblong bearing hole extending in an up-down direction, each of the fulcrum portions is a support shaft, and the support shaft is supported in the oblong bearing hole to be rotatable and slidable in the up-down direction, each of the damper members is a compression spring, and when the sheet discharge tray is located in the second position, with the pressing protrusion in contact with a top end of the compression spring, the compression spring is elastically deformed according to an amount of sheets stacked on the sheet discharge tray, and thereby the fulcrum portions slide inside the oblong bearing hole, and the sheet discharge tray moves in the up-down direction.

6. An image forming apparatus comprising:

an image forming portion which forms an image on a sheet;

the sheet discharging device of claim 1 which discharges the sheet having the image formed thereon in the image forming portion.

7. The image forming apparatus of claim 6, further comprising:

a motor which drives the discharge roller pair to rotate; and a controller which controls the motor, wherein when a print instruction including discharging operation which discharges the sheet to the sheet discharge tray is executed, the controller drives the motor to rotate the discharge roller pair, and thereby makes the sheet discharge tray pivot from the first position to the second position.

* * * * *